US005491942A

United States Patent [19]

Prokasky

[11] Patent Number: 5,491,942

[45] Date of Patent: Feb. 20, 1996

[54] MULTI-STORY BUILDING CONSTRUCTION EMPLOYING PREFABRICATED ELEMENTS

[76] Inventor: Thomas W. Prokasky, 8428 W. 97th St., Bloomington, Minn. 55438

[21] Appl. No.: 760,707

[22] Filed: Sep. 16, 1991

[51] Int. Cl.[6] ..... E04H 1/00

[52] U.S. Cl. ..... 52/236.3; 52/236.9; 52/79.4; 52/79.8; 52/79.9; 52/79.13; 52/481.1

[58] Field of Search ..... 52/236.3, 79.8, 52/79.9, 79.13, 79.14, 48.61, 479, 693, 537, 506.07, 236.9, 79.4, 481.1

[56] References Cited

U.S. PATENT DOCUMENTS

| | | | |
|---|---|---|---|
| 3,418,776 | 12/1968 | Manderbach et al. | 52/481.1 |
| 3,678,637 | 7/1972 | Klifel | 52/79 |
| 3,724,143 | 4/1973 | Paukulis | 52/79 |
| 3,813,835 | 6/1974 | Rice | 52/227 |
| 3,824,750 | 7/1974 | Antoniou | 52/79.13 |
| 3,894,373 | 7/1975 | Willingham | 52/236.3 |
| 4,010,579 | 3/1977 | Galvagni | 52/79.8 |
| 4,021,976 | 5/1977 | Colma | 52/79.7 |
| 4,023,315 | 5/1977 | Stucky | 52/79.13 |
| 4,048,772 | 9/1977 | Gaul | 52/236.3 |
| 4,228,623 | 10/1980 | Menosso | 52/79.3 |
| 4,263,757 | 4/1981 | Thys | 52/236.3 |
| 4,548,013 | 10/1985 | Briceño | 52/506.07 |
| 4,653,237 | 3/1987 | Taft | 52/693 |
| 4,679,375 | 7/1987 | Shirey | 52/506.07 |
| 4,989,382 | 2/1991 | Spronken | 52/236.3 |

FOREIGN PATENT DOCUMENTS

| | | | |
|---|---|---|---|
| 0607279 | 10/1960 | Canada | 52/79.14 |
| 2431578 | 3/1980 | France | 52/79.14 |
| 0614204 | 7/1978 | U.S.S.R. | 52/236.3 |
| 0626189 | 9/1978 | U.S.S.R. | 52/79.14 |
| 1090817 | 5/1984 | U.S.S.R. | 52/236.3 |

*Primary Examiner*—Carl D. Friedman
*Assistant Examiner*—Christopher Todd Kent

[57] ABSTRACT

A building construction employing elongated inverted L-shaped elements AB and partial elongated inverted L-shaped elements B. The building elements are juxtapositioned, in contact, laterally and end-wise and are stacked with the vertical legs of the elements substantially aligned, to form multi-story buildings. The vertical legs are substantially panel form bearing wall components B and the horizontal legs are substantially panel form floor-ceiling components A. Partition wall components C, perimeter wall components D or a number of other components or parts may be included in the construction. Extensive voids are included in the components. Components are fabricated of relatively light weight parts that can be economically handled by hand and fabricated employing hand tools.

20 Claims, 5 Drawing Sheets

MULTI-STORY BUILDING CONSTRUCTION EMPLOYING PREFABRICATED ELEMENTS

BACKGROUND—FIELD OF INVENTION

The present invention relates to multi-story building construction employing prefabricated elements.

BACKGROUND—DESCRIPTION OF PRIOR ART

It is well known that the construction of multi-story buildings by traditional methods results in excessively high costs and long construction periods that delay beneficial occupancy in spite of extensive efforts having been expended to reduce costs and construction periods. A substantial pan of these efforts have focused on a plethora of building constructions employing prefabricated elements.

One approach to prefabrication of building elements is to fabricate box-like room, or partial room, elements and to transport the elements to the building site, usually by truck. The disadvantages common to this approach are that substantial lifting and handling devices are required to handle the bulky, heavy elements requiring considerable capital investment in equipment. Moreover, usually only a single element can be transported at a time by mack resulting in substantial transportation expenses.

U.S. Pat. No. 4,023,315 to Stucky (1977) is one such example of prior an that suffers the additional disadvantages of requiting expensive temporary shoring, in-situ post tensioning and/or mid span connection plus fire-proofing and finishing procedures of the joint between paired elements.

U.S. Pat. No. 4,010,579 to Galvagni (1977) is another example that suffers similar disadvantages plus the need to capitalize elaborate form-work and plastic material (concrete) mixing and handling equipment in addition to the expense of connecting and finishing an excessive number of joints in each room. Moreover, Galvagni's invention shares, with other systems that employ concrete as a primary material, the disadvantage of being relatively heavy increasing the costs of supporting structures, footings, etc..

A second general approach to prefabrication of building elements is to fabricate elements that employ various combinations of horizontal and vertical components fabricated into three dimensional building elements in forms less complete, or enclosed, than a box.

U.S. Pat. No. 3,678,637 to Klifel (1972) is an example that has the disadvantage of having a geometry of pairs of structural units in side-by-side relationship being stacked over similar pairs of structural units alternating at each level 90 degrees to the adjoining pairs of units above and below, a rigid geometry that is a great disadvantage in the consumer oriented U.S. market that values variety and choice.

U.S. Pat. No. 3,724,143 to Paukulis (1973) discloses a building comprised of elongated T-shaped elements and partial elongated T-shaped elements that require a means of connecting opposing horizontal flanges at about the midpoint of the span between vertical supports, which being the point of maximum bending moment, requires an in-situ installed connecting means of extraordinary strength and a means of fireproofing and finishing the visually obvious seams. Moreover, Paukulis' building construction is inherently unstable employing elements that are supported on a single stem requiring expensive temporary bracing during construction.

U.S. Pat. No. 4,021,096 to Colma (1977) discloses a rigid geometry that arbitrarily locates windows and doors and thus, like Klipfel, lacks the flexibility to offer the variety of forms that the U.S. market demands.

U.S. Pat. No. 4,228,623 to Menosso (1978) is based on inverted "U" and "L" and open topped box shaped elements constructed of concrete. In addition to the capitalization requirements, transportation bulk and weight disadvantages of concrete, Menosso's invention is substantially based on inverted "U" forms resulting in double walls further exacerbating it's shortcomings and resulting in exorbitant costs.

All multi-story building construction, including systems employing prefabrication of elements, heretofore known suffer from one or more of a number of disadvantages:

(a) systems that have rigid geometries that can not be employed in a variety of forms necessary to satisfy U.S. consumer tastes have failed to be accepted commercially.

(b) systems susceptible to weather/climatic conditions have failed when weather delays have caused increased costs or unacceptable delays in beneficial occupancy.

(c) systems that require relatively fixed fabrication facilities have failed as the demand in geographic service area falls below the level of economic operation.

(d) systems that require relatively lengthy periods of fabrication and/or construction have failed because the cost of overhead, supervision, security and construction financing interest are excessive. Moreover, income producing occupancy is delayed.

(e) systems that are relatively heavy or bulky have failed due to the cost of transportation and handling. In addition, structural and footing requirements are greater to support heavy systems.

(f) systems that are not fire-resistive, to meet building codes for multi-story buildings, are prohibited from use. Prefabricated systems that require fire-resistive assemblies to be incorporated in-situ require increased construction time thus losing a cost advantage.

(g) systems that do not accommodate concealment of mechanical and electrical components are generally unacceptable to the market.

(h) systems that require substantial capital investment have failed commercially due to the inability to generate a sufficient volume of income, during cycles of low demand, to service the debt.

OBJECTS AND ADVANTAGES

It is the general object of this invention to provide multi-story building construction employing relatively light weight prefabricated elements at a favorable cost that can be employed in a comparatively short construction period and in a variety of forms to satisfy consumer tastes. Several specific objects and advantages of the present invention are to provide a multi-story building construction:

(a) that can be employed in a considerable variety of forms to meet U.S. consumer demands.

(b) that can be employed effectively in most climates and weather conditions having minimal temperate requirements and having elements that shed water protecting work and materials below.

(c) whose fabrication tools and devices are relatively portable and can be employed in nonspecific facilities generally available in many geographic areas.

(d) that minimizes fabrication/construction time and associated expenses by employing materials that do not require curing time and by employing light weight prefabricated elements that can be comparatively large in size.

(e) that is comprised of components that are light weight and in panel form that can be transported and handled easily and economically and that require relatively less structural support and footings.

(f) that incorporate a substantial pan of the fire-resistive materials, required by codes in multi-story construction, in the fabrication process to reduce costs.

(g) that employs elements with internal voids for concealment of mechanical and electrical elements.

(h) that employs components that can be fabricated with a minimum capital investment consisting primarily of hand tools and mobile lifting devices.

Further objects and advantages will become apparent from consideration of the following drawings and descriptions.

DRAWING FIGURES

Figure 8:
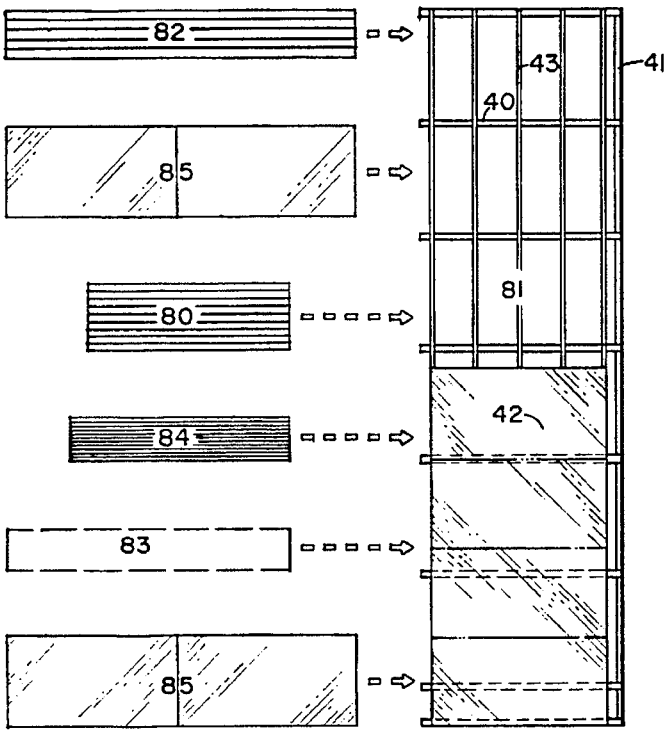

FIG. 8 shoves a schematic layout of the fabrication of bearing wall components.

Figure 9:
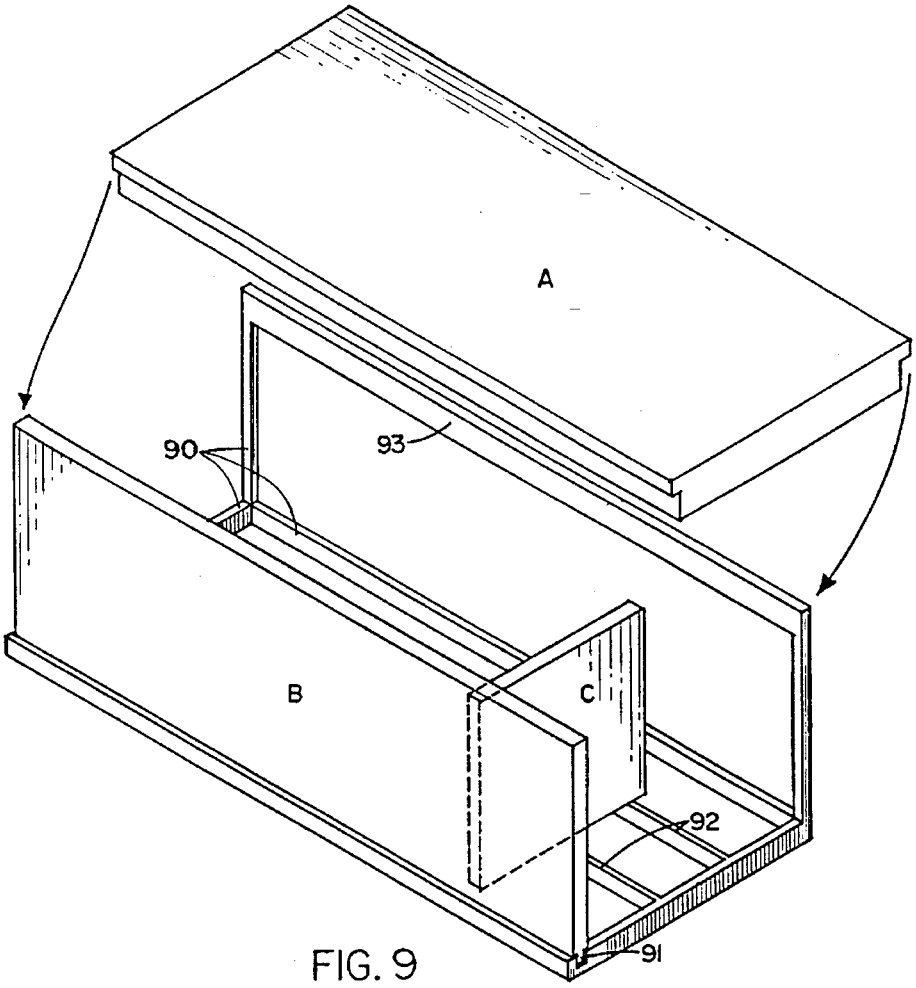

FIG. 9 shows a schematic orthographic view for the assembly of components into a building element.

Figure 10:
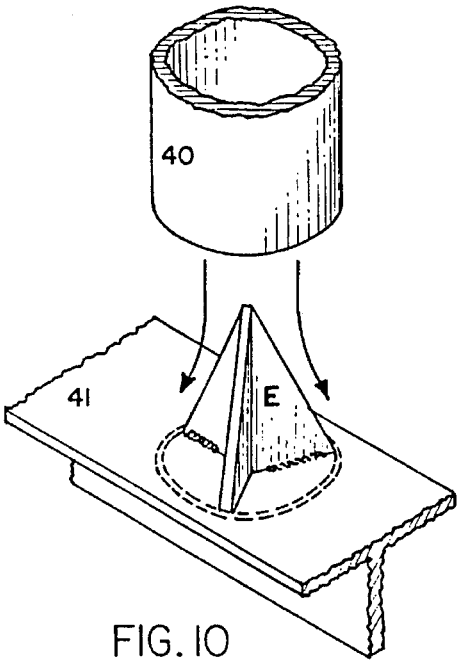

FIG. 10 shows a orthographic view of a pipe form of a load-bearing stud being lowered onto an alignment guide.

Figure 11:
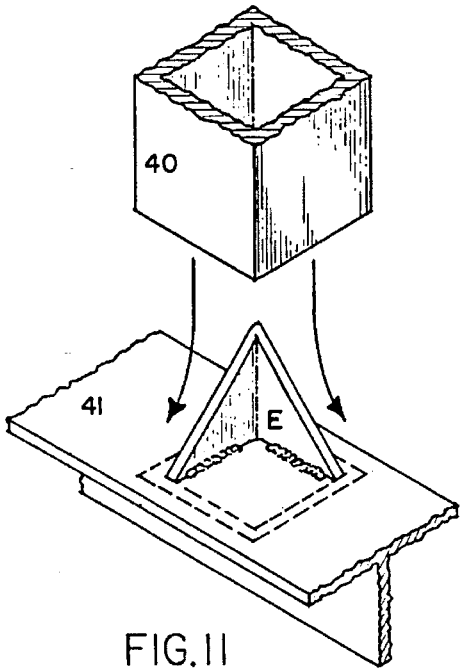

FIG. 11 shows a orthographic view of a square tube form of a load-bearing stud being lowered onto an alignment guide.

DETAILED DESCRIPTION OF THE INVENTION

Figure 1:
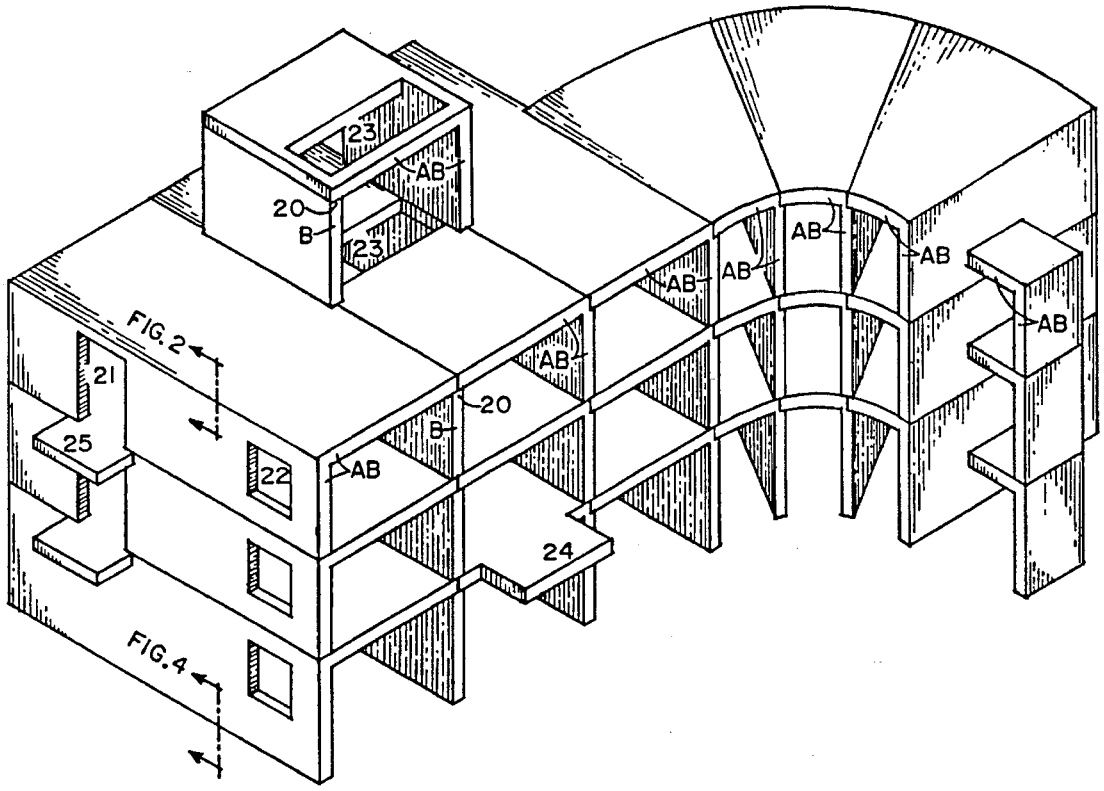
FIG. 1 shows an orthographic view of the building construction illustrating a number of forms of the elements and a number of representative relationships between them.

It should be understood that FIG. 1 is meant to schematically illustrate some of the forms that the elements, in combination, can achieve. Embodiments of structure and the method of fabrication, assembly and placing is explained later.

Form. A variety of forms of the multi-story building construction employing embodiments of elements of the present invention are illustrated in FIG. 1. The principle elements have elongated inverted L-shaped forms AB comprised of a planar horizontal leg, or floor-ceiling component, A and a planar vertical leg, or bearing wall component, B joined along their congruent edges. Partial elongated inverted L-shaped elements are substantially comprised of a planar vertical leg, or bearing wall component, B. Note that the partial elements are usually deployed under the edge of the floor-ceiling component opposite the edge congruent with the bearing wall component of the same element where the non-congruent edge is not in contact with an adjoining principal element 20. FIG. 1 shows several layers, or levels, each comprised of a number of elements. Note that the bearing wall components, being the principal vertical supporting members, are in substantial vertical alignment.

Discontinuities 21 between beating wall components may provide openings for corridors, lateral extensions of rooms, or spaces, or may be filled with window or doors. Voids or partial discontinuities 22 may be created to allow passage of mechanical or electrical components, for window, or for other purposes. Voids in floor-ceiling components 23 may be created to provide vertical communication between spaces by stairs or elevators, to allow passage of mechanical or electrical components, or for other purposes. Viewing FIG. 1 it can be readily perceived that by employing a number of elements wedge-shaped in plan view, that curved buildings, or multi-curved S-shaped buildings may be created, moreover, by using wedge-shaped elements whose narrower ends are all together a complete circle form can be created. Note that the wedge-shaped elements may be truncated to various extents or have the edges, not congruent with a bearing wall component, that are curved arc segments or are straight chords. Analogously, the plan view form of the elements may be trapezoidal, rhomboidal or a number of other forms. Moreover, in side view, the top edge of the bearing wall components may be sloped creating a ramped floor or roof surface. FIG. 1 shows a number of extensions of the planar horizontal members past the ends of the planar vertical members 24 and transversely beyond them 25. Summarily, FIG. 1 demonstrates that the basic elongated, inverted L-shaped form of the elements of the present invention can be employed to create a wide variety of embodiments as shown and as can be readily perceived analogously to form, in combination, multi-story building constructions of a variety of forms to satisfy U.S. consumer demands.

Figure 2:
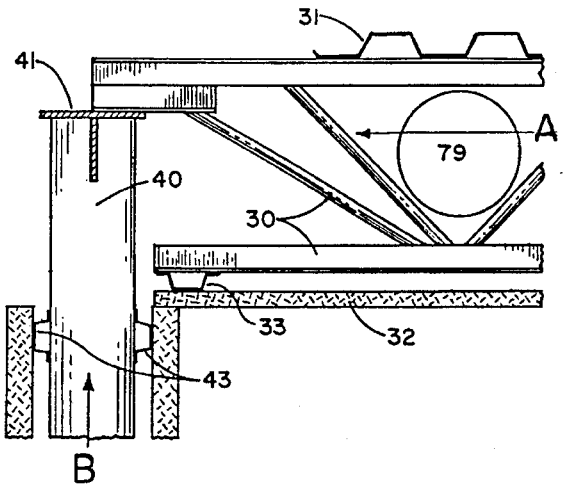
FIG. 2 shows a transverse section through the meeting of a floor-ceiling component and a bearing wall component of an element.
Figure 3:
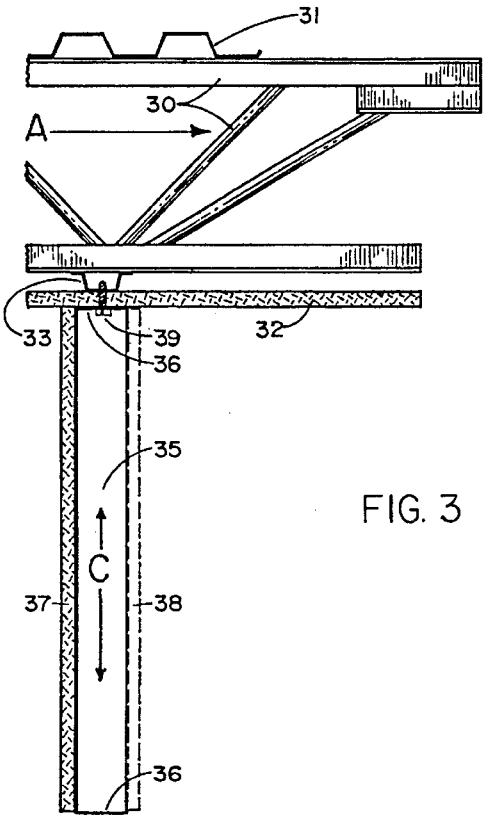
FIG. 3 shows a transverse section through the edge of a floor-ceiling component opposite the edge in contact with the bearing component of an element and a partition wall component.

Structure. FIG. 2 shows a transverse section through the joint between a preferred embodiment of the floor-ceiling component and, a bearing wall component that, in combination, form the inverted L-shaped elements of the present invention. FIG. 3 shows a transverse section through the edge of the floor-ceiling component opposite the edge congruent with the bearing wall component shown in FIG. 2. Elongated horizontal load bearing members, or joists, 30 are shown here to be steel with open webs between top and bottom chords. Another embodiments might be C-shaped cold formed steel joists or rolled form structural steel members of any of a number or shapes. A generally planar horizontal sheet, or deck, 31 is shown to be channeled steel sheets. Other embodiments of the deck may include: flat, corrugated, or ribbed panels of a cementous compound reinforced with steel or inorganic fibers. A horizontal ceiling panel 32 as shown, is fabricated of a plurality of paper faced gypsum panels. A ceiling panel securing means, or ceiling furring, 33 here shown as hat-shaped in section, are usually deployed in substantially parallel rows transverse to the joists. Other ceiling furring may be employed including, but not limited to channel or C-shaped metal members. It should be noted that the ceiling panel and it's securing means might not be included as pan of the floor-ceiling panel when fabricated but, in one of several possible embodiments, may be incorporated in another step as will be described later.

FIG. 3 also illustrates a partition wail component C, unique to the invention, that includes a wall pan and a tensile partition attachment means 39 securing this component to a floor-ceiling component of an inverted L-shaped building element. A preferred embodiment of the wall pan is that of a rectilinear flame comprised of a plurality of fight gauge cold rolled metal C-shaped elongated vertical members, or studs 35, determinally spaced with channels 36 of similar material secured across both ends, forming a frame to which a partition panel 37 is secured. It is preferred that a second partition panel 38 is secured to the frame in situ allowing access to the cavity in the partition wall component for employing a tensile attachment means during assembly of the elements and allowing access to incorporate other items. FIG.3 shows the tensile attachment means 39 being serf tapping screws driven upwards through the ceiling panel securing means 33 of the floor-ceiling component. It should be noted that the partition wall components may be deployed before the ceiling panel and thus be attached directly to the bottom flanges of the joists, or to other metal support members of the floor-ceiling component above. In such cases welding is an acceptable tensile attachment means.

Figure 4:
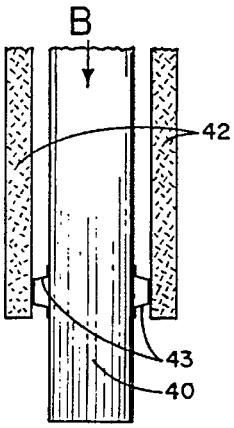
FIG. 4 shows a transverse section through the lower end of a bearing wall component.

FIG.4 shows a transverse section through the bottom edge of a bearing wall component. The bearing wall component is comprised of a number of vertical load bearing members, or load bearing studs, 40 spaced at determined intervals and sized to carry the vertical loads imposed as well as to resist the effect of horizontal seismic and wind forces. The preferred embodiment is a rectilinear structural steel tube or steel pipe although other steel sections such as 'T' or 'H' may be used. An elongated horizontal top member, or top plate, 41 extends continuously over the load bearing studs transferring the vertical loads superimposed on it by the joists and the horizontal wind and seismic forces to the load bearing studs below. The T-shaped embodiment shown has a continuous horizontal flange and a vertical stem interrupted by each load bearing stud. It should be understood that a number of other configurations of this member will be suitable. A vertical planar member, or wall panel, 42 serves multiple purposes unique to the present invention including: enclosure of interior spaces (room walls), sound proofing between interior spaces, and envelope fireproofing of the steel structure, obviating the need for fire resistant enclosures for individual structural members. The wall panel disposed on the perimeter of the building serves as sheathing and fireproofing and may have additional exterior facing materials superimposed over it. A preferred embodiment of the wall panel is comprised of multiple layers of paper faced gypsum panels however, other fire-resistive materials may be used including, for example, a panel of metal or gypsum lath upon which plaster is applied. A wall panel attachment means, or wall furring, 43 is shown as a hat-shaped section of corrosion resistant metal, usually spaced at about 24 inches on center transverse to the vertical load bearing members, however, a number of other shapes and gauges or different spacing may be successfully employed. Additionally, a number of light gauge metal studs, and other parts may be interspersed between load bearing studs serving as support and spacers for the wall panel attachment means and as framing for discontinuities or voids in the bearing wall components. It is intended that metal to metal connections be made by welding, however, bolts and self tapping screws may be employed in many instances. Panel to panel support connections are intended to be made with screws, however, adhesives, clips or similar devices may be employed in some instances.

Figure 5:
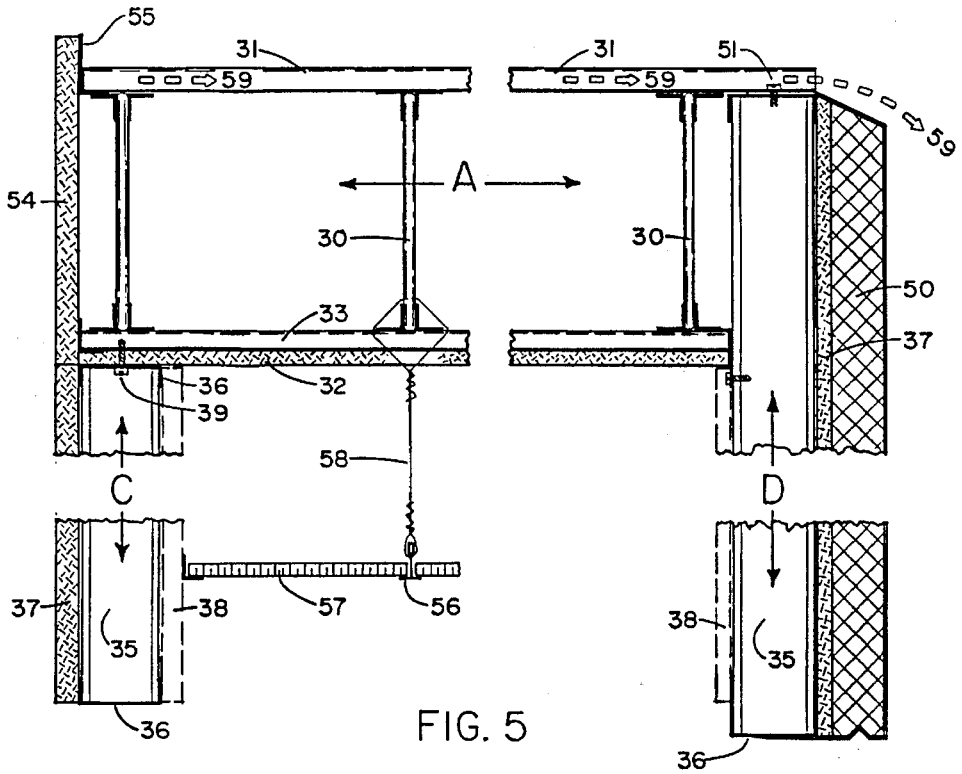
FIG. 5 shows a transverse section through a partition wall component and perimeter wall component and their attachment to a floor-ceiling component.

FIG. 5 shows a non-load bearing perimeter wall component D attached to the bottom side of the channeled metal deck 31 of the floor-ceiling component above. This embodiment of a perimeter wall component has similar parts to the partition wall component C and may be faced with a variety of exterior facing materials 50. Note that the tensile attachment means may be self tapping screws 51 or welding that may be employed from above. FIG. 5 also illustrates the meeting of a partition wall component C with a floor-ceiling component A at a vertical discontinuity such as a elevator shaft A closure panel 54 provides fire protection for the floor-ceiling assembly. Part 55 is a bulkhead to contain concrete topping. A planar ceiling panel consisting of a grid of elongated metal members 56 supporting panels of fire-resistive material infilled 57, or secured to the underside of the grid suspended on metal wires 58 a determined distance below a floor-ceiling component may be incorporated in-situ. Importantly, note that the deck extends to the perimeter 59 allowing water to drain off of the top-most floor-ceiling components during construction.

Figure 6:
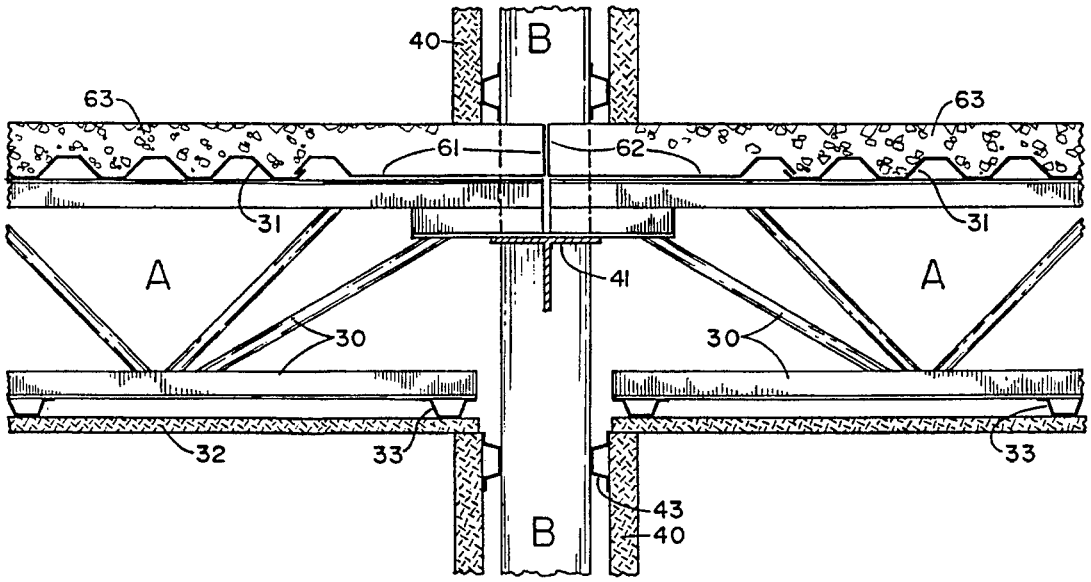
FIG. 6 shows a transverse section through the intersection of two bearing wall and two floor-ceiling components including bulkheading and topping.

FIG. 6 illustrates a transverse section through the intersection of two floor-ceiling components A and two bearing wall components B and illustrates deployment bulkheading 61 & 62 and topping 63. While bulkhead 55 can be incorporated during fabrication of the floor-ceiling component, one can see that the bulkheading 61 & 62 and topping 63 will be incorporated in-situ after the placing and joining of the building elements whose components meet at the intersection illustrated. Note that this construction novelty facilitates the fastening of structural parts and the joining of mechanical and electrical parts of each of the components together in the exposed void before closing with bulkheading.

Fabrication. My invention accomplishes prefabrication of the components with minimum capital investment and maximum portability by the unique concept of incorporation of parts of a size and weight that, in most cases can be handled manually by one or two workers and that are joined into components by employing portable (usually hand-held) equipment. Fabrication is executed on a relatively level surface which if not paved and sufficiently level, a level framework, or 'jig' laid on grade will suffice. The preferred location of the fabrication process is on the building site if space allows but remote locations can be satisfactory in that the fabricated components are light, flat panels easily and economically transported by truck to the building site for assembly. A tent or similar temporary and portable shelter may be employed to shelter the fabrication process in most climates at on-site locations or off-site buildings will serve. Note that minimal temperature control is required as the fabrication process of this invention is "dry" using no liquid subject to freezing such as water used in mixing concrete.

Figure 7:
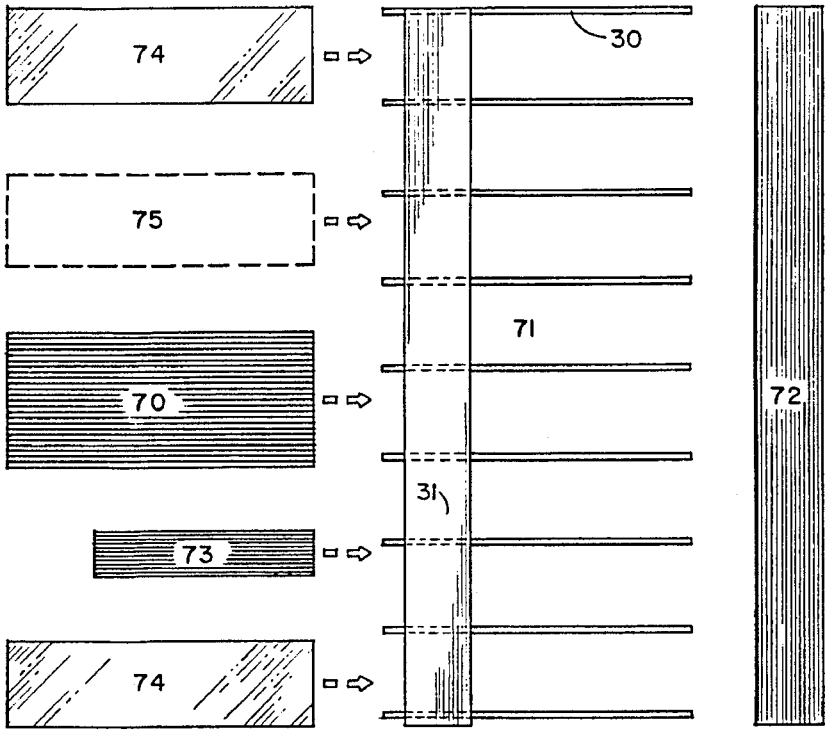
FIG. 7 shows a schematic layout for the fabrication of floor-ceiling components.

FIG. 7 shows a schematic layout for the fabrication of the floor-ceiling components. (a) Each horizontal load bearing member, or floor joist, is carried from the Joist Supply Area 70 to it's predetermined location on the Fabrication Floor (or Jig) 71. Typical residential (hotel, apartment) Joist spacing might be about 4 feet on center with joist length about 14 feet, for which an American Steel Joist Institute designation 10K1 open web steel joist weighing approximately 70 pounds is sufficient, an easy carry for two workers. Joist spacing, length and size may vary depending on design conditions. Formed fight gauge steel or rolled steel shapes may be employed in lieu of the suggested joists with acceptable results. (b) Sheets of corrugated steel deck are carried from the Deck Supply Area 72 and are laid out in predetermined positions on top the joists. A typical deck sheet might be of 20 to 26 gauge steel, have ribs about 0.6 to 1.5 inches high, be approximately 30 to 36 inches wide and up to about 40 feet long, a typical sheet weighing about 120 pounds if galvanized is a reasonable carry for two workers. The deck sheets -are then secured to the joists, usually by multiple welds or other fasteners such as self tapping screws. (c) Next, the deck and joist assembly is turned over by employing a lifting device. (d) If a ceiling panel is to be installed during this step the ceiling attachment means, an acceptable embodiment of which might be roll formed, hat-shaped sections of 25 gauge corrosion resistant steel furring, are carried from the Furring Supply Area 73 and placed on the bottom chords (now on top) of the joists, generally in parallel rows spaced 24 inches apart, transverse to the joists and secured with welds or tied with multiple strands of steel wire. (e) Next, the ceiling panels are carried from the Ceiling Panel Supply Area 74 and laid side by side on the furring and attached to the furring with screws. A preferred embodiment of the ceiling panel is ⅝ inches thick and 4 feet wide paper faced gypsum panels. A panel about 13.5 feet long for example, weighing approximately 129 pounds is a reasonable carry for two workers. The procedure of prefabricating the ceiling panel is omitted in embodiments of the invention wherein a ceiling component is suspended at a determined distance below the bottom of the joists such component being best incorporated in-situ. Various mechanical and electrical items may be incorporated into the floor-ceiling panel during fabrication. As shown in FIG. 2 round ducts 79 up to 6 inches in diameter can be run transverse to 10K1 joists for example and substantial longitudinal voids are available between the joists.

Fabrication of bearing wall components. Prefabricafion of the beating wall components is accomplished similar to the floor-ceiling components. FIG. 8 shows, schematically, a layout for the fabrication process (a) Load-bearing studs are carried from the Load-Bearing Stud Supply Area 80 to determined locations on the Fabrication Floor Area 81. A typical load bearing stud for a residential height bearing wall might be a 4 inch by 4 inch square structural steel tube with ¼ inch thick walls, 9 feet 2 inches in length weighing about 112 pounds, a reasonable carry for two workers. (b) An elongated steel top plate is carried from the Top Hate Supply Area 82 to the Fabrication Floor and is positioned in contact with the top ends of the load bearing studs and is welded securely to them. The top plate may be of a number of sizes and configurations depending of the spacing of the studs that will support it, the vertical and horizontal loads imposed on it and a number of other factors. In most cases a T-shaped steel member about ¼ inch thick whose top leg is about 5 inches wide and extends, continuously over the studs and whose vertical leg extends between and is interrupted by each bearing stud is suitable. (c) Framing pans are carded from the Framing Pans Supply area 83 to the Fabrication Floor 81 and juxtapositioned in determined relationship to the load bearing studs such that the framing pans serve to frame openings and ends of the bearing wall component and serve as additional support for wall furring. Typical framing pans may include light gauge, cold rolled steel 'C' studs, angles, channels and other shapes. (d) Furring is carried from the Furring Supply Area 84 to the fabrication floor and laid on top of and generally transverse to the studs in parallel rows, usually 24 inches on center and welded or screwed to the studs. "Hat" shaped sections of 25 gauge corrosion resistant metal are acceptable, however, a number of other gauges and shapes may be successfully used. (e) Next, the wail panel parts are carried from the Wall Panel Supply Area 85 to the fabrication floor and are arranged over the furring, similar to the ceiling panel previously described, and secured with screws. The preferred embodiment of the wall panel consists of two layers of ⅝ inches thick by 4 feet wide paper faced gypsum wall panel parts although other fire resistive panels may be employed including lath and plaster panels applied in-situ. (f) The bearing wall fabrication is lifted by its top plate edge by lifting device and laid back down with the installed wall panel face down. The steps of applying furring and the wall panel are repeated on the opposite (now top) side of the bearing wall fabrication. Mechanical and electrical items may be incorporated in the voids between the wall panels and between the studs and framing parts during fabrication. (g) The substantially complete bearing wall components are now moved to another on-site location for assemble with the floor-ceiling components or if fabricated off-site they are trucked to the site assembly location. The fabrication process for partition and perimeter wall components C,D is generally similar to that for the bearing wall components.

Assembly FIG. 9. Assembly of the components into building elements is accomplished on an assembly frame 90. The purpose of the frame is to hold the bearing wall component accurately aligned and vertical in a determined position in the dement. (a) The bearing wall component B is lowered onto channels 91 in the free. Close tolerances between the inside walls of the channel and the studs of the bearing wall component hold the component substantially vertical. (b) Partition walls C, if any, are placed in upright positions on the horizontal members 92 of the alignment frame and are held in vertical alignment. (c) The Perimeter wall component, if any, is placed in juxtaposition to the bearing wall component and is fixedly attached to it. (d) The floor/ceiling component A is lowered onto the assemblage of wall components in it's horizontal attitude until the ends of the joists on one edge of the floor/ceiling panel rest on the top plate of the bearing wall component and the opposite edge is supported by a crossbar 93 of the assembly frame that is disposed at the same height as the top plate. (e) All components are securely attached to each other to form an inverted L-shaped building dement comprised of the beating wall and floor/ceiling components and, optionally, with various other components. It should be appreciated that FIG. 9 is a schematic representation of an assembly frame and that other embodiments of the flame will satisfactorily serve the assembly process. Frame 92 might be replaced with a firm level floor on which devices similar to Christmas tree stands are deployed to receive the bottom of the studs of the bearing wall component holding the component vertical. Pieces of blocking may be deployed to support the partition and perimeter wall components at the height that their tops engage to bottom of the floor-ceiling component. The crossbar 93 may be deployed with stand devices upon the floor.

Placing. A lifting device lifts a building element to a position directly above it's permanent position in the building. The element is then guided by workers as it is lowered into position. As illustrated in FIG. 10 and 11, immediately above the element's permanent position the bottom of several beating studs 30 engage the alignment guides E of the element below. As the element is lowered over the guides towards the guides'widening base, the bearing studs are forced to center accurately on the guides, novelly obviating a number of alignment and squaring procedures and the need to employ temporary alignment and holding devices. Elements are secured to each other by welding the bottom of the bearing studs of an element to the top plate of the bearing wall component of the element below and by welding the ends of the joists, opposite the ends congruent with the bearing wall component of the same element, to the top plate of the element juxtapositioned side by side it. Elements placed end to end are secured together by welding or bolting the ends of their top plates together.

While any number of elements can be stacked vertically or placed side by side or end to end horizontally, the preferred embodiment of the invention is that end to end placement be limited to two elements allowing the inside ends of the channeled deck to be bulkheaded so rain or melting snow can drain over the unique edge 59 at the perimeter of the building. Note that temporary cover plates may be laid over the meeting between the topmost in-place elements to complete the protection. It is of considerable advantage to be able to continue work below in all weather.

Topping is employed over decks to provide a smooth firm floor surface and for fire protection of metal pans such as the channeled steel sheets 31 of the preferred embodiment of the deck. Bulkheading means are employed around the perimeter of the deck to be topped. FIG. 5, illustrates a permanent bulkhead pan 55 in the form of a metal angle at the edge of a discontinuity in a floor-ceiling component. Bulkheading means may be of a number of forms that may include temporary blocking. Topping is usually applied in-situ as a portland cement concrete in a plastic state. However, solid panels of a number of compositions may serve as well, an alternate that obviates the need for a bulkheading means.

Summarily, the reader will see that the particular form of the elements of the present invention can be expressed in numerous novel variations that, combined, can result in building structures that meet U.S. consumer demands for variety and choice. The panel form components can be handled and transported easily and economically. The structure being a unique combination of light weight pans facilitates fabrication without the need of substantial capitalization of relatively non-portable fabrication tools and devices and requires less structural support than systems employing concrete or conventional use of steel. Moreover, the structure of the present invention accommodates mechanical and electrical items and includes a substantial pan of the fireproofing required by codes. The novel method of fabrication, assembly and placing substantially reduces the length of the construction period reducing expenses and allowing early occupancy. Thus the form, structure and method of the present invention create a synergistic affect resulting in substantial economies, speed of construction, commercial flexibility and variety of design.

The embodiments heretofore described should be considered illustrative and not restrictive, the scope of the invention being indicated by the appended claims rather than by the foregoing description, and all changes or modifications that come within the true scope and meaning of the claims is intended to be embraced therein.

I claim:

1. A multi-story building construction comprising a plurality of elongated inverted L-shaped elements each having a substantially vertical bearing wall component and and a substantially horizontal floor-ceiling component, joined along a congruent edge; and at least one partial L-shaped element comprised of a substantially vertical bearing wall component; said inverted L-shaped and partial L-shaped elements being arranged such that a substantial length of an edge of said floor-ceiling components, opposite said congruent edge, is attached to the bearing wall component of the laterally adjacent inverted L-shaped or partial L-shaped element; the bearing wall components of the elements being in substantial vertical alignment with bearing wall components of elements on a predetermined number of levels below; the bearing wall components being comprised of:

a. a plurality of vertical load bearing members in determined positions in a spaced relationship to each other;

b. an elongated horizontal top member in contact with, extending across the tops of and fixedly attached to said vertical load bearing members;

c. a first wall panel attached to one side of the plurality of vertical load bearing members with a wall panel attachment means;

d. a second wall panel attached to the side opposite said one side of the plurality of vertical lead bearing members;

such that the two wall panels form generally parallel and vertical planes with the vertical load bearing members sandwiched between;

the floor-ceiling components being comprised of:

e. a plurality of elongated horizontal load bearing members in determined positions in a spaced relation to each other, generally parallel;

f. a generally planar horizontal sheet disposed on top of and secured to said horizontal load bearing members;

g. a substantially horizontal ceiling panel disposed below and secured to the horizontal load bearing members with a ceiling panel securing means;

whereby a light-weight building construction with voids wherein mechanical, electrical and other items may be incorporated, can be rapidly assembled.

2. The construction of claim 1 wherein at least some of said bearing wall components having discontinuities for providing openings for lateral extensions of rooms or for installing windows or doors.

3. The construction of claim 1 wherein at least some of said horizontal sheets and ceiling panels have openings for vertical communication by stairs or elevator, or for passage of mechanical or electrical items.

4. The construction of claim 1 wherein said horizontal load bearing members are perforated laterally with a plurality of substantial voids.

5. The construction of claim 1 wherein said horizontal sheet is channeled steel arranged such that at least one end of said channels of said horizontal sheet occurs at a perimeter of the building construction.

6. The construction of claim 1 further including a topping comprising a bulkheading means secured to the perimeters of the top surface of the floor-ceiling components and a layer of concrete disposed on said top surface.

7. The construction of claim 1 further including a guiding means comprising a pyramidal shaped alignment guide fixedly attached to said elongated top member of the bearing wall component, said alignment guide having a base perimeter slightly smaller than a void in the end of the vertical load bearing member; whereby the vertical load bearing member is lowered over the alignment guide into accurate alignment by the pyramidal shape of the alignment guide obviating the need for deploying and removing temporary guiding and alignment devices.

8. The construction of claim 1 further including a plurality of partition wall components and a plurality of perimeter wall components secured to the underside of at least some of the floor-ceiling components with tensile attachment means.

9. The construction of claim 1 wherein the ceiling panel comprises a plurality of fire resistant paper faced gypsum sheets disposed side by side in a generally horizontal layer.

10. The construction of claim 1 wherein the ceiling panel comprises a grid of elongated metal members with panels of fire resistive material and the ceiling panel securing means consists of a plurality of metal wires extending from the underside of the floor-ceiling component downwards a determined distance to said metal grid.

11. A multi-story building construction comprising a plurality of elongated inverted L-shaped elements each having a planar vertical leg and a planar horizontal leg joined along a congruent edge; and at least one partial L-shaped element comprised of a planar vertical leg; said inverted L-shaped and partial L-shaped elements being arranged such that a substantial length the the edge of said horizontal leg, opposite said congruent edge, is attached to the the vertical leg of a laterally adjacent inverted L-shaped or partial L-shaped element; the vertical legs of the elements being in substantial vertical alignment with the vertical legs of elements on a predetermined numbers of levels below; the vertical legs being comprised of:

a. a plurality of load bearing studs in determined positions in a spaced relationship;

b. a top plate in contact with and extending across the tops of and fixedly attached to said load bearing studs;

c. a first vertical planar member attached to one side of the plurality of load bearing studs;

d. a second vertical planar member attached to the side opposite said one side of the plurality of studs;

such that the two vertical planar members form generally parallel planes with the load bearing studs sandwiched between;

the planar horizontal legs being comprised of:

e. a plurality of joists in determined positions in a spaced relation to each other, generally parallel;

f. a deck disposed on top of and secured to said joists; and g. a substantially horizontal ceiling panel disposed below and secured to the joists with a ceiling panel securing means.

12. The construction of claim 11 wherein at least some of said planar vertical legs having discontinuities for providing openings for lateral extensions of rooms or for installing windows or doors.

13. The construction of claim 11 wherein at least some of said decks of said horizontal legs and ceiling panels have openings for vertical communication by stairs or elevator, or for passage of mechanical or electrical items.

14. The construction of claim 11 wherein said joists are open webbed between top and bottom chords.

15. The construction of claim 11 wherein said deck is corregated and arranged such that at least one end of said corregations occurs at a perimeter of the building construction.

16. The construction of claim 11 further including a topping comprised of a layer of concrete applied over the top of the deck.

17. The construction of claim 11 further including guiding means comprising a pyramidal shaped alignment guide fixedly attached to said top plate of the vertical leg, said alignment guide having a base perimeter slightly smaller than a void in the ends of said load bearing studs whereby, the stud is lowered over the alignment guide of a vertical leg below said stud is guided into accurate alignment by the alignment guide.

18. The construction of claim 11 further including a plurality of partition wall components secured to the underside of at least some of the horizontal legs with partition attachment means.

19. The construction of claim 11 wherein the ceiling panel comprises a plurality of fire resistant paper faced gypsum sheets disposed side by side in a generally horizontal layer.

20. The construction of claim 11 wherein the ceiling panel comprises a grid of elongated metal members with panels of fire resistive material and the ceiling panel securing means consists of a plurality of metal wires extending from the underside of the floor-ceiling component downwards a determined distance to said metal grid.

* * * * *